US012110896B2

(12) United States Patent
Schofield et al.

(10) Patent No.: US 12,110,896 B2
(45) Date of Patent: Oct. 8, 2024

(54) AXIAL FLOW VACUUM PUMP WITH CURVED ROTOR AND STATOR BLADES

(71) Applicant: Edwards Limited, Burgess Hill (GB)

(72) Inventors: Nigel Paul Schofield, Burgess Hill (GB); Stephen Dowdeswell, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 17/904,143

(22) PCT Filed: Feb. 10, 2021

(86) PCT No.: PCT/GB2021/050301
§ 371 (c)(1),
(2) Date: Aug. 12, 2022

(87) PCT Pub. No.: WO2021/161010
PCT Pub. Date: Aug. 19, 2021

(65) Prior Publication Data

US 2023/0109154 A1 Apr. 6, 2023

(30) Foreign Application Priority Data

Feb. 13, 2020 (GB) ..... 2001992

(51) Int. Cl.
*F04D 19/04* (2006.01)
*F04D 29/32* (2006.01)
(Continued)

(52) U.S. Cl.
CPC ..... *F04D 19/048* (2013.01); *F04D 29/32* (2013.01); *F04D 29/38* (2013.01); *F04D 29/542* (2013.01)

(58) Field of Classification Search
CPC ..... F04D 19/04; F04D 19/042; F04D 19/048; F04D 29/324; F04D 29/058; F04D 29/542; F04D 29/544; F04D 17/168
See application file for complete search history.

(56) References Cited

U.S. PATENT DOCUMENTS 6,200,107 B1 * 3/2001 Brewster ..... F04D 27/0207 417/520
6,457,954 B1 * 10/2002 Adamietz ..... F04D 29/602 417/423.4
(Continued)

FOREIGN PATENT DOCUMENTS

EP 1004775 A2 5/2000
EP 1574719 A2 9/2005
(Continued)

OTHER PUBLICATIONS

British Examination Report dated Jul. 13, 2020 and Search Report dated Jul. 10, 2020 for corresponding British Application No. GB2001992.3, 8 pages.
(Continued)

*Primary Examiner* — Juan G Flores
*Assistant Examiner* — Ryan C Clark
(74) *Attorney, Agent, or Firm* — Theodore M. Magee; Westman, Champlin & Koehler, P.A.

(57) ABSTRACT

An axial flow vacuum pump for evacuating a chamber in a semiconductor manufacturing process comprises a rotor having a plurality of rotor blades and a stator having a plurality of stator blades, wherein the rotor blades and stator blades have a curved shape.

13 Claims, 5 Drawing Sheets

(51) Int. Cl.
*F04D 29/38* (2006.01)
*F04D 29/54* (2006.01)

(56) References Cited

U.S. PATENT DOCUMENTS 6,499,942 B1 * 12/2002 Nonaka ..... F04D 29/324 416/243
6,508,621 B1 * 1/2003 Zeighami ..... F04D 25/166 415/199.2
6,591,851 B1 * 7/2003 Palten ..... F04D 27/00 137/12
6,736,606 B1 * 5/2004 Ohmi ..... F04D 25/00 417/244
6,817,377 B1 * 11/2004 Reimer ..... F04D 27/0261 137/565.33
6,910,861 B2 * 6/2005 Beyer ..... F04D 29/324 415/211.2
7,140,847 B2 11/2006 Boger et al.
10,267,321 B2 * 4/2019 Nonaka ..... F04D 17/168
10,662,957 B2 * 5/2020 Nonaka ..... F04D 17/168
10,823,200 B2 * 11/2020 Sakaguchi ..... F04D 19/04
2002/0076317 A1 6/2002 Reimer et al.
2004/0013529 A1 1/2004 Englander et al.
2004/0037695 A1 2/2004 Beyer et al.
2004/0081569 A1 * 4/2004 Sakaguchi ..... F04D 19/04 417/423.4
2004/0096311 A1 * 5/2004 Englander ..... F04D 29/266 415/90
2011/0008176 A1 * 1/2011 Ohbayashi ..... F04D 29/384 416/242
2015/0275914 A1 * 10/2015 Tsutsui ..... F04D 17/168 415/177
2017/0350395 A1 * 12/2017 Schofield ..... C23C 16/4405

FOREIGN PATENT DOCUMENTS

JP H09303288 11/1997
WO 2018100342 A1 6/2018

OTHER PUBLICATIONS

PCT Notification of Transmittal of the International Preliminary Report on Patentability dated Apr. 20, 2021 and PCT International Search Report dated Apr. 20, 2021 for corresponding PCT application Serial No. PCT/GB2021/050301, 6 pages.
PCT Written Opinion dated Apr. 20, 2021 for corresponding PCT application Serial No. PCT/GB2021/050301, 7 pages.
European Communication dated Jun. 28, 2024 for corresponding European application Serial No. 21706668.7, 8 pages.
Hablanian, The axial flow compressor as high vacuum pump, Advances in vacuum science and technology: proceedings of the First International Congress of Vacuum Technique, 1958.

* cited by examiner

AXIAL FLOW VACUUM PUMP WITH CURVED ROTOR AND STATOR BLADES

CROSS-REFERENCE TO RELATED APPLICATION

This application is a Section 371 National Stage Application of International Application No. PCT/GB2021/050301, filed Feb. 10, 2021, and published as WO 2021/161010A1 on Aug. 19, 2021, the content of which is hereby incorporated by reference in its entirety and which claims priority of British Application No. 2001992.3, filed Feb. 13, 2020.

FIELD

The invention relates to an axial flow vacuum pump for evacuating a chamber in a semiconductor manufacturing process. Apparatus comprising an axial flow vacuum pump and methods of evacuating a semiconductor fabrication chamber using an axial flow vacuum pump are also provided.

BACKGROUND

There is an increasing requirement to operate semiconductor chambers over a broad range of pressures (0.005 to 5 mbar) with very high pumping speed.

Vacuum pumps are typically designed and configured to operate effectively across a particular pressure range. No one pump can operate effectively across all pressure ranges.

At low pressures, in the molecular flow regime, turbomolecular pumps are effective, while at higher pressures, in the viscous flow regime, rough pumps such as roots-blower pumps are effective. In the transitional flow regime at pressures where both molecular and viscous flow occur drag pumps may suitably be used.

There is an increasing requirement to operate semiconductor chambers over a range of pressures that can be too high for a turbo pump to sustain without overheating (typically pressures above 0.05 mbar), but are too low for a remotely mounted roots blower to be effective due to the conductance of the connection pipe (typically less than 0.2 mbar).

This requires the use of very large roots blowers and backing pumps mounted in the basement below the chamber. This is increasingly becoming a problem as there is insufficient space for these pumps, and the conductance loss in the pipework reduces the effective pumping performance at the chamber. What is needed is a tool mounted vacuum booster that gives high pumping speed over this range of pressures.

It would be desirable to provide a pump that has a sufficiently large capacity for evacuating (at least in part) a chamber in a semiconductor manufacturing process and is effective at pumping at pressures conventionally pumped by drag pumps.

The discussion above is merely provided for general background information and is not intended to be used as an aid in determining the scope of the claimed subject matter. The claimed subject matter is not limited to implementations that solve any or all disadvantages noted in the background.

SUMMARY

In accordance with the invention, there is provided an axial flow vacuum pump for evacuating a chamber in a semiconductor manufacturing process. The axial flow vacuum pump comprises a rotor having a plurality of rotor blades and a stator having a plurality of stator blades. The rotor blades and stator blades have a curved cross-sectional shape.

At pressures in the viscous flow regime, for example 1 mbar or higher, the curved shape of the blades can compress gas entering in the inlet in the same way as an axial flow compressor. At relatively lower pressures, in the molecular flow regime, for example 0.001 mbar or lower, the curved blades may also act to direct molecules of gas towards the outlet. Furthermore, such an axial flow vacuum pump incorporating curved rotor and stator blades has been found to operate with surprising effectiveness over the medium vacuum or transition regime, for example between 1 mbar and 0.001 mbar. Not only does the axial flow vacuum pump display efficacy over the different flow regimes but the applicant has also found that such a pump can produce high pumping speeds with relatively small footprint that would have considerable advantages for use in a semiconductor manufacturing process.

Whilst particularly suitable for use in such semiconductor manufacturing processes, it will be appreciated that the axial flow vacuum pumps described herein may also find utility in other applications especially where it is desired to operate over a range of pressure regimes.

The axial flow vacuum pump has an annular flow path between the stator and rotor into which the rotor blades and stator blades extend and is configured such that gas flows through it substantially parallel to the rotor axis.

In order to be suitable for evacuating a chamber in a semiconductor manufacturing process, the vacuum pump must be made from materials suitable for use in the harsh environments of semiconductor manufacture. For example, the materials need to be able to operate effectively at high temperatures of 130 degrees Celsius or more. In embodiments the pump may be configured to operate at temperatures of between 150 and 200 degrees Celsius. In addition to operating at high temperatures, the materials need to be able to operate effectively in the presence of corrosive compounds. In embodiments, the pump is configured to pump gases comprising fluorine.

The axial flow vacuum pump comprises a plurality of rotor and stator blades having a curved cross-sectional shape such as an aerofoil shape. More specifically the curved or aerofoil shape will include a leading edge at the front of the blade, i.e. towards the inlet of the pump, and a trailing edge at the rear of the blade, i.e. towards the outlet of the pump or exhaust. A curved pressure surface and a curved suction surface extend from the leading edge to the trailing edge of the blade on opposing sides. The aerofoil is configured to produce an aerodynamic force. The inventors have found that using curved shaped blades instead of the straight blades used in standard turbomolecular pumps allows the pump to operate over a greater pressure range and therefore be effective at pressures higher than a turbomolecular pump.

The rotor and stator blades may be arranged into respective pumping stages, each stage including a rotor stage comprising a plurality of rotor blades and a stator stage comprising a plurality of stator blade. The axial flow vacuum pump may thus comprise a plurality of pumping stages.

The rotor blades in a particular rotor stage of the pump may have the same shape and size as other rotor blades in the same stage. Similarly, stator blades rotor blades may have the same shape and size as other rotor blades in the same stage. However, rotor blades and stator blades within the same stage do not need to have the same shape as one another but could have different shapes as known in the art. Moreover, the rotor blades in one stage may have a different shape to the rotor blades in another stage. Similarly, a single rotor stage may contain rotor blades having different shapes. The same may be true for stator blades.

In embodiments, all the rotor blades and all the stator blades may have an aerofoil shape. However, this need not be the case and various arrangements would be possible in this regard. For instance, in combination with a plurality of curved rotor and stator blades, there may also be provided one or more straight blades, either within the same pumping stage as the curved blades or in a different stage of the pump.

In embodiments, a motor is coupled to the rotor and configured to drive the rotor about its axis. The motor may be an electric motor such as a permanent magnet motor.

The rotor may be supported for rotation relative to the stator by magnetic bearings. Magnetic bearings are configured to support load using magnetic levitation. Such bearings may also be referred to as magnetically levitated bearings. They support load without the need for physical contact and therefore reduce friction and eliminate the need for lubricating oil that may cause contamination. Magnetic bearings also produce less vibration compared to other types of contacting bearings and can be more reliable. The use of magnetic bearings allows the vacuum pump to be positioned on or very close to the semiconductor processing chamber. A long conduit between the pump and the chamber it is evacuating significantly reduces the pumping efficiency, particularly when pumping at low pressures. Accordingly, the use of magnetic bearings allows the axial flow vacuum pump to operate effectively in the molecular flow regime.

The rotor may be formed from stainless steel. In embodiments the stator may also be formed from a stainless steel. The stator and rotor may generally be formed from the same material, or from different materials. The use of stainless allows the pump to be used at higher temperatures compared to aluminium for example. Operation at higher temperatures reduces the risk of condensates forming on the pumping surfaces, which may occur during semiconductor manufacture due to the resulting by-products. In embodiments, the rotor and stator are formed from a high strength stainless steel.

The rotor and stator blades each have a radial length extending from the rotor towards the stator in the case of a rotor blade (in which case the radial length is measured as the largest radial length between the rotor and the tip of the blade) or from the stator towards the rotor in the case of stator blades (in which case the radial length is measured as the largest radial length). An inlet stage of the pump comprises blades having a first radial length and an adjacent downstream stage of the pump comprises blades having a second radial length. In embodiments the rotor and/or stator blades in the inlet stage have a greater radial length than the rotor and/or stator blades in the downstream stages of the pump. For example, in embodiments the ratio of first radial length to second radial length is 1.5:1 or greater, for example 2:1 or greater.

The use of blades having a longer radial length at an inlet stage of the pump, although not effective during viscous flow, optimises performance of the pump when operating in the molecular flow regime. Having a greater length of the blades at the inlet stage of the pump may help to capture more gas molecules entering the pump and send them into the pumping channels to progress through the pump. The inlet of the pump sees the lowest pressure and it is at this point that the capture of molecules is the most challenging.

In embodiments, the pump has one or more inlet stages where the ratio of radial length between adjacent stages is 2:1 or greater, for example 3:1 or greater. The pump may also have a plurality of compression stages downstream of the inlet stages where the ratio of between adjacent stages is between 1:1 and 1.5:1, for example 1.2:1. In embodiments, the number of inlet stages is fewer than the number of regular stages. For example, the pump may have one or two inlet stages and 4 or more regular compression stages.

The axial flow vacuum pump may comprise between 4 and 10 pumping stages, each pumping stage comprising a row of rotor blades and a row of stator blades.

In embodiments, the axial flow vacuum pump includes between 6 and 8 pumping stages. One or more of the pumping stages may be configured to achieve a compression ratio of between 1.1:1 an 1.5:1, for example 1.2:1, when operating in the viscous flow regime and a compression ratio of between 2:1 and 4:1, for example 3:1, when operating in the molecular flow regime.

The axial flow vacuum pump may comprise a bypass conduit for directing a portion of the gas from the outlet of the pump towards the inlet of the pump. The bypass conduit may be internal or external to the pump. In other words the bypass conduit may comprise an external pipe mounted to the outlet or outlet conduit of the pump and extending towards the inlet of the pump or may be integral with the pump such as a conduit formed within the stator or an outer casing thereof for directing the gas in such a manner.

The bypass conduit may comprise a pressure relief valve. The pressure relief valve may be configured to open at a pressure of 50 mbar or higher, for example at a pressure of between 50 mbar and 200 mbar or between 80 mbar and 120 mbar or around 100 mbar.

Also in accordance with the invention, there is provided an apparatus for manufacturing semiconductor equipment. The apparatus comprises a chamber for manufacturing semiconductor equipment in, a backing pump system positioned remote from the chamber and configured to evacuate gas from the chamber and a foreline for fluidly connecting the backing pump system to the chamber. The apparatus further comprises an axial flow vacuum pump according to any of the embodiments described above configured to evacuate gas from the chamber, wherein the axial flow vacuum pump is connected between the chamber and foreline.

In embodiments the backing pump system comprises a roots blower and a primary pump. A set of vacuum pumps including an axial flow vacuum pump backed by a further pump system such as a roots blower and primary pump provides an effective pumping arrangement for a vacuum chamber such as a semiconductor processing chamber to be evacuated to a pressure of between 1 mbar and 5×10-2 mbar. Such pressures are appropriate for semiconductor processes including semiconductor device fabrication processes such as ALD (atomic layer deposition) processes.

The axial flow vacuum pump as described above provides a relatively high pumping speed at relatively low pressures, but only has a modest compression ratio, particularly at the higher pressures of its operating range. However, when used in conjunction with a roots-blower pump, this combination can provide the required compression across the pressure range, owing to the complementary properties of the roots blower and the axial flow vacuum pump. In this regard the constraint for effective operation of the roots blower in the evacuation of a semiconductor vacuum chamber is the length of the conduit required as the roots-blower cannot be mounted within the clean room. However, using it in conjunction with an axial flow vacuum pump that can be mounted on the chamber or at least very close to it in the clean room/fab and which evacuates effectively at the lower pressures of the operational range, provides a combination of pumps which can effectively evacuate a semiconductor processing chamber across the full pressure range of 1 mbar to $5\times10^{-2}$ mbar.

The chamber may house one or more tools used to form semiconductor equipment. The chamber may be positioned in a clean room. The axial flow vacuum pump may be attached directly to the chamber or at least very close to the chamber. For example, the axial flow vacuum pump may be positioned less than 2 meters from the chamber or preferably less than 1 meter from the chamber, for example the pump may be positioned on the chamber. The axial flow vacuum pump may be positioned in the same room as the chamber. The chamber and axial flow vacuum pump may both be positioned in a clean room. A longer conduit is used for connecting said vacuum pump to said roots blower and primary pump such that said roots blower and primary pump are located remotely from said semiconductor processing chamber. The longer conduit is there to allow the roots blower pump to be situated remotely from the vacuum chamber and the clean room.

The backing pump system may be positioned more than 8 meters from the chamber. In embodiments, the backing pump system may be positioned outside of the room in which the chamber is positioned. For example, the backing pump system may be positioned on a separate floor to that of the chamber such as in the subfab or basement below the chamber. In embodiments, the axial flow vacuum pump and chamber are positioned together on the same floor and the backing pump system is positioned on a floor below.

Also in accordance with the invention, there is provided a method of evacuating a semiconductor fabrication chamber. The method comprises using an axial flow vacuum pump as described in any of the embodiments above to evacuate gas from the chamber, operating the axial flow vacuum pump to pump gas with a pressure of 1 mbar or higher, operating the axial flow vacuum pump to pump gas with a pressure of between 1 mbar and 0.001 mbar and operating the axial flow vacuum pump to pump gas with a pressure of 0.001 mbar or lower.

The method may comprise using a backing pump system to evacuate gas from the chamber, the backing pump system being positioned remotely from the chamber and axial flow vacuum pump.

In embodiments, the backing pump system may be positioned outside of the room in which the chamber is positioned. For example, the backing pump system may be positioned on a separate floor to that of the chamber such as in the subfab or basement below the chamber. In embodiments, the axial flow vacuum pump and chamber are positioned together on the same floor and the backing pump system is positioned on a floor below.

The axial flow vacuum pump may be positioned less than 2 meters from the chamber. [In embodiments, the axial flow vacuum pump is positioned less than 1 meter from the chamber, for example the pump may be positioned on the chamber. The axial flow vacuum pump may be positioned in the same room as the chamber. The chamber and axial flow vacuum pump may both be positioned in a clean room. The backing pump system may be positioned more than 8 meters from the chamber.

In embodiments, the method comprises operating the axial flow vacuum pump to pump gas at a temperature of 130 degrees Celsius or higher.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
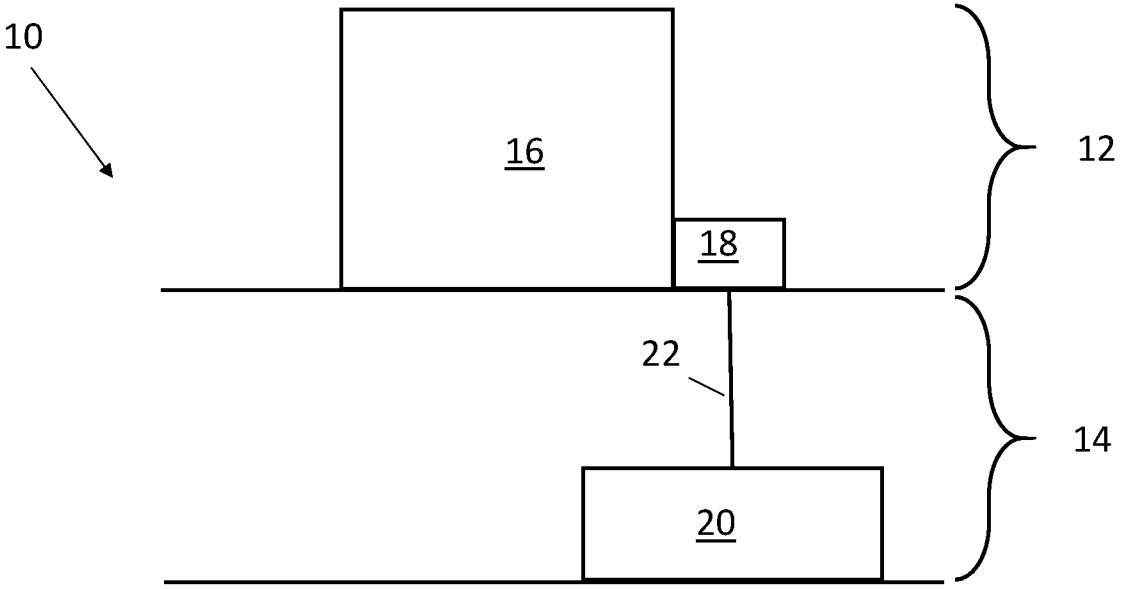
FIG. 1 shows a semiconductor fabrication chamber and a pumping arrangement for evacuation the chamber according to an embodiment.

FIG. 1 is a schematic illustration of apparatus 10 for manufacturing semiconductor equipment. The illustrated apparatus 10 is positioned over two floors. An upper floor 12 having a clean room in which a chamber 16 and axial flow vacuum pump 18 is positioned and a lower floor 14 in which a backing pump system 20 is positioned. The chamber 16 and axial flow vacuum pump 18 are connected to the backing pump system 20 via a foreline 22. Although only two floors are illustrated for simplicity, it will be appreciated that the apparatus 10 may be positioned over further floors, particularly where additional equipment such as exhaust management and temperature management systems may be required. Moreover, each floor may comprise multiple rooms in which various parts of the apparatus may be positioned, as is known in the art.

In use, semiconductor equipment is manufactured within the chamber 16 using one or more tools (not shown). In order to effectively manufacture semiconductor equipment, the gas pressure in the chamber should be very low. For example, in many semiconductor processes, the pressure in the chamber 16 needs to be $10^{-2}$ mbar or lower. As such the axial flow vacuum pump 18 and backing pump system 20 are configured to evacuate gas from the chamber 16 to achieve such pressures.

The backing pump system 20 comprises a roots blower and primary pump or other similar arrangement for backing the axial flow vacuum pump 18. Such a backing pump system can be very bulky and create considerable noise, as such it is positioned separately from the main manufacturing processes in the chamber 16, in the illustrated example, the backing pump system 20 is positioned on a floor below the chamber 16 in a so called 'subfab' area of the manufacturing facility. As the chamber 16 and backing pump system 20 are on separate floors there is a considerable distance between the chamber 16 and backing pump system 20. As such the foreline 22 is eight meters long or greater. A long gas flow path between the backing pump system 20 and chamber 16 reduces pumping effectiveness of the backing pump system 20 particularly at low pressures.

An axial flow vacuum pump 18 is attached directly to the chamber 16. It will be appreciated that the axial flow vacuum pump 18 may also be positioned close to the chamber 16 such that a short conduit, less than 2 meters, runs between the chamber 16 and axial flow vacuum pump 18.

The combination of the axial flow vacuum pump 18, with relatively high pumping capacity attached close to the chamber 16, and the backing pump system 20, which can pump effectively at the high pressures of the effective pumping range, provides a set of pumps which pump effectively across the desired pumping range with an increased pumping capacity compared to known systems.

Figure 2:
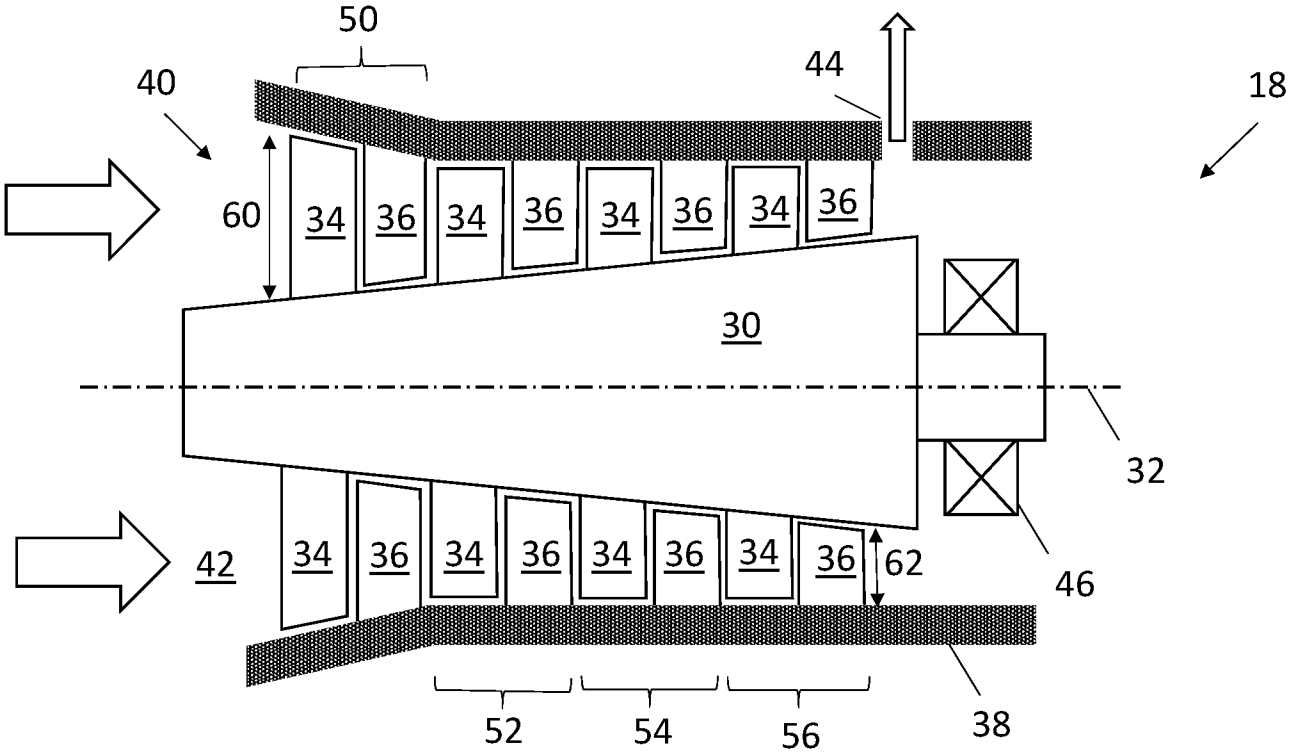
FIG. 2 shows a schematic sectional view of a vacuum pump according to an embodiment of the invention.

FIG. 2 shows a cross sectional view of an example axial flow vacuum pump 18 for the pumping apparatus 10 of FIG. 1.

The axial flow vacuum pump 18 comprises a rotor 30 configured to rotate about the pump axis 32 during use and has a plurality of rotor blades 34 mounted on it. The pump 18 further comprises a stator 38 surrounding the rotor 30 and having a plurality of stator blades 36 mounted on it. The rotor 30 and stator 38 define an annular flow path 40 extending from an inlet 42 to an outlet 44 of the pump into which the rotor blades 34 and stator blades 36 extend. The annular flow path 40 has a cross-sectional area that decreases along axial direction from the inlet 42 to the outlet 44.

The rotor 30 is supported for rotation relative to the stator 38 by magnetic bearings 46. Although the illustrated embodiment shows a single magnetic bearing 46 positioned near the outlet end of the rotor 30, it will be appreciated that other bearing configurations including one or more bearings may be used.

The rotor 30 is formed from high strength stainless steel which is capable of effectively operating at temperatures between 150 and 180 degrees Celsius, in use.

The rotors blades 34 and stator blades 36 are arranged in stages 50, 52, 54, 56 as shown in FIG. 2. Each stage 50, 52, 54, 56 comprises a row of rotor blades 34 configured to rotate about the axis 32 in use and a row of stator blades 36 configured to remain stationary, fixed to the stator 38, in use. The illustrated vacuum pump 18 has four stages 50, 52, 54, 56. An inlet stage 50, comprising an inlet rotor blades 34 and inlet stator blades 36, is positioned at the inlet 42 to the pump 18. Three further compression stages 52, 54, 56, each comprising a row of rotor blades 34 and a row of stator blades 36, are positioned downstream of the inlet stage 42 towards the outlet 44 of the pump 18. Although four stages have been shown in FIG. 2, it will be appreciated that fewer or more stages may be present depending on the desired compression characteristics of the pump 18.

Each stage of the pump 18 has an associated volume that decreases from the inlet 42 towards the outlet 44 such that an upstream stage will have a greater volume than stage downstream of. This volume decrease facilitates compression of the gas in the viscous flow regime. The volume decrease may be achieved by decreasing the internal diameter of the stator 38 and/or increasing the external diameter of the rotor 30 along the axis 32 of the pump 18 in a direction from the inlet 42 to the outlet 44. In the illustrated example, the internal diameter of the stator 38 decreases in the inlet stage 50 but remains generally fixed in the further compression stages 52, 54, 56 and the external diameter of the rotor 30 increases throughout all stages. It will be appreciated that other configurations of stator 38 and rotor 30 geometries that achieve the desired volume decrease, as set out in more detail below, are also within the scope of the invention.

Accordingly, each stage 50, 52, 54, 56 has a compression ratio which is defined as a ratio of the volume of that stage to the volume of the adjacent downstream stage. The compression ratio of the further compression stages 52, 54, 56 (i.e. downstream of the inlet stage) is around 1.2:1. The compression ratio of the stage will directly affect the length of the rotor and stator blades 34, 36 of the stage compared to the length of the rotor and stator blades 34, 36 in the adjacent downstream stage. More specifically, the rotor blades 34 in each row have a radial length 60 extending from the rotor 30 towards the stator 38 and the stator blades 36 each have a radial length 62 extending from the stator 38 towards the rotor 30. Where the compression ratio is around 1.2:1 ratio between radial length of rotor blade (or stator blade) between stages is also around 1.2:1.

By comparison, the inlet stage 50 comprises blades 34 having a much longer radial length 60 compared to those of adjacent stages, such that the ratio is much higher than would be optimal for achieving desired pressure ratios during viscous flow. More specifically, the inlet stage 50 has a compression ratio of around 3:1 and a rotor and stator blade length 60, 62 such that the ratio of blade length 60, 62 of the inlet stage 50 to the blade length 60 of the adjacent stage 52 of the pump 18 is around 3:1.

It will be appreciated that more than one inlet stage 50 having longer blades may be provided although the number of inlet stages configured in this way will be fewer than the number of regular compression stages.

Figure 3:
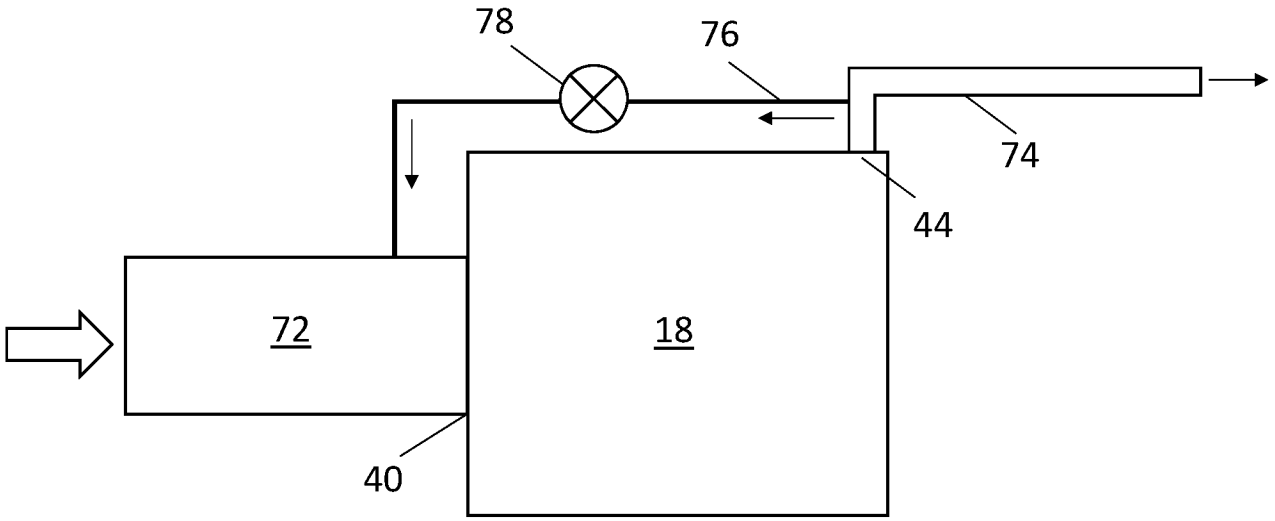
FIG. 3 shows the vacuum pump of FIG. 2 with a bypass configuration.

The axial flow vacuum pump of FIG. 2 has a bypass configuration 70 to optimise pumping performance. FIG. 3 is a schematic representation of the pump 18 showing the inlet 72, outlet 74 and bypass conduits 76. An inlet conduit 72 is attached to the inlet 40 of the pump 18 such that gas from the chamber (not shown) is directed into the pump 18 via the inlet conduit 72, in some examples the inlet conduit 72 may be part of the chamber itself such that the pump 18 is mounted directly to the chamber. An outlet conduit 74 is attached to the outlet 44 of the pump 18. The outlet conduit 74 feeds directly into the pumping system foreline (not shown) or may be part of the foreline itself such that the outlet conduit 74 directs gas from the pump 18 towards the backing pump system, eight or more metres away. A bypass conduit 76 is attached to the outlet conduit 74 at or adjacent to the outlet 44 of the pump 18 and is configured to direct a portion of the gas in the outlet conduit 74 back towards the inlet 40 of the pump 18.

The bypass conduit 76 includes a pressure relief valve 78 positioned between the outlet conduit 74 and inlet conduit 72. The pressure relief valve 78 is configured to open at 100 mbar. It will be appreciated that the pressures relief valve may be configured to open at a pressure of 50 mbar or higher, for example at a pressure of between 50 mbar and 200 mbar or between 80 mbar and 120 mbar, depending on the pressure conditions of system.

The vacuum pump 18 of FIG. 2 differs from a standard turbomolecular pump in that each of the rotor and stator blades 34, 36 has a substantially curved cross-sectional shape as is shown in greater detail in FIGS. 4 and 5 below.

Figure 4:
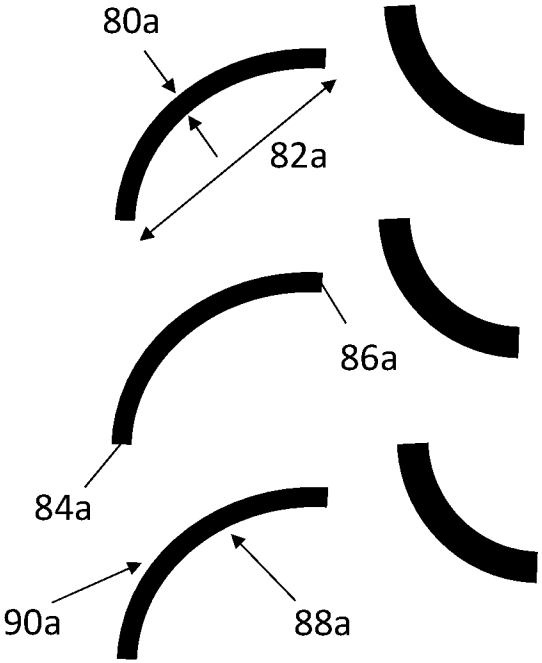
FIG. 4 shows example cross sectional profiles of blades for a compression stage of the pump of FIG. 2.

FIG. 4 shows an example cross sectional profile of blades 34, 36 for a stage of the pump 18 of FIG. 2. The stage comprises a row of rotor blades 34*a* and a row of stator blades 36*a*. For simplicity, only three rotor blades 34*a* and three stator blades 36*a* are shown here, however it will be appreciated that many more than three blades will be mounted around the circumference of the rotor 30 at each stage.

In the configuration of FIG. 4, the blades have a generally uniform thickness 80*a* along its chord length 82*a* such that they may be made from sheet metal that is bent to form a curved profile. More specifically the curved shape will include a leading edge 84*a* at the front of the blade, i.e. towards the inlet of the pump, which is generally flat, and a trailing edge 86*a* at the rear of the blade, i.e. towards the outlet of the pump or exhaust, which is also generally flat. A curved pressure surface 88*a* and a curved suction surface 90*a* extend from the leading edge 84*a* to the trailing edge 86*a* of the blade on opposing sides.

Figure 5:
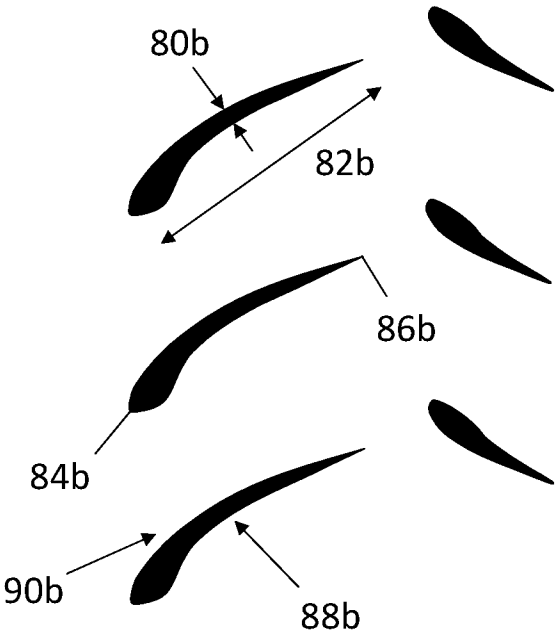
FIG. 5 shows further example cross sectional profiles of blades for a compression stage of the pump of FIG. 2.

In the alternative configuration of FIG. 5, the blades are aerodynamically optimised to form aerofoil cross-sectional shapes. More specifically the aerofoil shape includes a leading edge 84*b* at the front of the blade, which is generally curved and a trailing edge 86*b* at the rear of the blade which is generally pointed. A curved pressure surface 88*b* and curved suction surface 90*b* extend from the leading edge 84*b* to the trailing edge 86*b* of the blade on opposing sides. The thickness 80*b* of the cross-sectional profile varies across the chord length 82*b* such that it has a greater thickness 80*b* towards the leading edge 84*b* and a lesser thickness 80*b* towards the trailing edge 86*b*.

Figure 6:
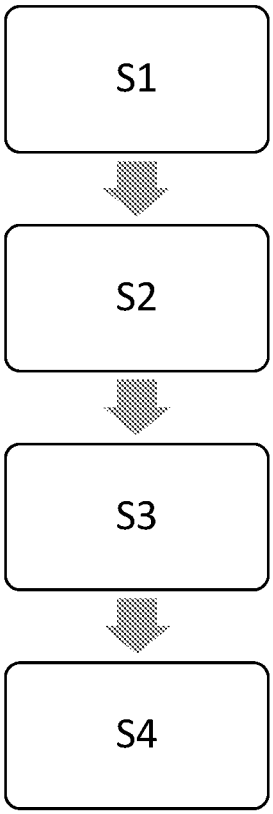
FIG. 6 illustrates a method of evacuating a semiconductor fabrication chamber.

FIG. 6 illustrates a method 100 of evacuating a semiconductor fabrication chamber using the apparatus as described above. In particular, the use of the axial flow vacuum pump 18 mounted directly on or very close to the semiconductor chamber 16 as shown in FIG. 1, with the backing pump system 20 backing the axial flow vacuum pump 18 from a position remote from it.

Step 1 S1 of the method 100 comprises operating the axial flow vacuum pump to pump gas with a pressure of 1 mbar or higher, step 2 S2 comprises operating the axial flow vacuum pump to pump gas with a pressure of between Imbar and 0.001 mbar and step 3 S3 comprises operating the axial flow vacuum pump to pump gas with a pressure of 0.001 mbar or lower. As such the axial flow vacuum pump is used to pump gas over the viscous flow regime and molecular flow regime as well as in the transition between the two regimes.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. An axial flow vacuum pump for evacuating a chamber in a semiconductor manufacturing process, the axial flow vacuum pump comprising:

a rotor having a plurality of rotor blades; and a stator having a plurality of stator blades, wherein the rotor blades and stator blades have a curved aerofoil cross-sectional shape comprising a curved leading edge, a pointed trailing edge, a concaved pressure surface extending from the leading edge to the trailing edge and a curved suction surface extending from the leading edge to the trailing edge, wherein the concaved pressure surface of each rotor faces in a direction of rotation of the rotor;

wherein an inlet stage of the pump comprises blades having a first radial length and an adjacent downstream stage of the pump comprises blades having a second radial length, wherein the ratio of first radial length to second radial length is 2:1 or greater.

2. The axial flow vacuum pump of claim 1, wherein the rotor is supported for rotation relative to the stator by magnetic bearings.

3. The axial flow vacuum pump of claim 1, wherein the rotor is formed from stainless steel.

4. The axial flow vacuum pump of claim 1, comprising between 4 and 10 pumping stages, each pumping stage comprising a row of rotor blades and a row of stator blades.

5. The axial flow vacuum pump of claim 1, comprising a bypass conduit for directing a portion of a gas from an outlet of the pump towards the inlet stage of the pump.

6. The axial flow vacuum pump of claim 5, wherein the bypass conduit comprises a pressure relief valve.

7. An apparatus for manufacturing semiconductor equipment comprising:

a chamber for manufacturing semiconductor equipment in;

a backing pump system positioned remote from the chamber and configured to evacuate gas from the chamber;

a foreline for fluidly connecting the backing pump system to the chamber; and an axial flow vacuum pump according to claim 1 configured to evacuate the gas from the chamber, wherein the axial flow vacuum pump is connected between the chamber and foreline.

8. The apparatus of claim 7, wherein the axial flow vacuum pump is positioned less than 2 meters from the chamber.

9. The apparatus of claim 7, wherein the backing pump system is positioned more than 8 meters from the chamber.

10. A method of evacuating a semiconductor equipment fabrication chamber comprising:

using an axial flow pump as described in claim 1 to evacuate gas from the chamber;

operating the axial flow vacuum pump to pump the gas with a pressure of 1 mbar or higher;

operating the axial flow vacuum pump to pump the gas with a pressure of between 1 mbar and 0.001 mbar; and operating the axial flow vacuum pump to pump the gas with a pressure of 0.001 mbar or lower.

11. The method of claim 10, comprising using a backing pump to evacuate the gas from the chamber, the backing pump system being positioned remotely from the chamber and the axial flow vacuum pump.

12. The method of claim 10, wherein the axial flow vacuum pump is positioned less than 2 meters from the chamber.

13. The method of claim 10, comprising the axial flow vacuum pump to pump the gas at a temperature of 130 degrees Celsius or higher.

* * * * *